United States Patent [19]

Andrews et al.

[11] Patent Number: 4,480,955

[45] Date of Patent: Nov. 6, 1984

[54] COUPLING FOR EARTH MOVING TOOLS ETC.

[75] Inventors: Errol F. Andrews; Edward A. Peterson; Jeffrey N. Casbolt; Kevin E. Holt; John M. McMillan, all of Nambour; Robert E. Whiting, Yandina, all of Australia

[73] Assignee: Maroochy Shire Council, Nambour, Australia

[21] Appl. No.: 432,949

[22] PCT Filed: Feb. 2, 1982

[86] PCT No.: PCT/AU82/00004

§ 371 Date: Sep. 27, 1982

§ 102(e) Date: Sep. 27, 1982

[87] PCT Pub. No.: WO82/02731

PCT Pub. Date: Aug. 19, 1982

[30] Foreign Application Priority Data

Feb. 5, 1981 [AU] Australia ..... PE7482

[51] Int. Cl.[3] ..... E02F 3/96

[52] U.S. Cl. ..... 414/723; 37/117.5

[58] Field of Search ..... 414/686, 723; 172/272–275; 137/117.5, 42 R

[56] References Cited

U.S. PATENT DOCUMENTS

| | | | |
|---|---|---|---|
| 3,269,570 | 8/1966 | Wallberg . | |
| 3,512,665 | 5/1970 | Westendorf | 414/723 |
| 3,556,323 | 1/1971 | Heimmermann . | |
| 3,818,551 | 6/1974 | Coughran, Jr. | 414/723 X |
| 4,030,624 | 6/1977 | Matthews . | |
| 4,034,998 | 7/1977 | Iijima et al. . | |
| 4,085,856 | 4/1978 | Westendorf | 414/723 |
| 4,116,347 | 9/1978 | Uchida | 414/723 |
| 4,208,163 | 6/1980 | Holmquist . | |
| 4,236,329 | 12/1980 | Hetrick | 37/42 R |
| 4,251,181 | 2/1981 | Drott et al. | 414/723 |
| 4,265,587 | 5/1981 | Clark | 414/723 |
| 4,355,945 | 10/1982 | Pilch | 414/686 |

FOREIGN PATENT DOCUMENTS

| | | |
|---|---|---|
| 45831 | 12/1965 | Australia . |
| 86851 | 5/1977 | Australia . |
| 52987 | 11/1981 | European Pat. Off. . |
| 1417257 | 10/1965 | France . |
| 1465735 | 3/1977 | United Kingdom . |

*Primary Examiner*—Robert J. Spar
*Assistant Examiner*—Terrance L. Siemens
*Attorney, Agent, or Firm*—Schwartz, Jeffery, Schwaab, Mack, Blumenthal & Koch

[57] ABSTRACT

A quick release and attachment coupling for operating tools for earthmoving or excavating machines having an attachment head pivotally mounted on the boom of the machine. A locating head is fixed to, or formed integrally with, an operating tool and has a pair of spaced side plates, and stop members in the form of a transverse bar or beam and a hook or jaw. The attachment head is tightly positioned between the spaced side plates, with V-shaped slots at one end of the head engaged with the beam. A movable block in the head is moved by a hydraulic ram into engagement with the hook or jaw to lock the attachment head to the operating tool.

7 Claims, 3 Drawing Figures

COUPLING FOR EARTH MOVING TOOLS ETC.

FIELD OF THE INVENTION

This invention relates to a quick release and attachment assembly for earthmoving or excavating machines or the like.

BRIEF DESCRIPTION OF THE PRIOR ART

There are many types of earthmoving and excavation equipment where the operating tool, e.g. a bucket, blade or ripper pick, must be released from the machine for maintenance or replacement by a different tool. One example is an excavator, which may be operated with buckets of differing widths and/or cubic capacities.

The task of releasing the operating tools from a machine, and attaching a replacement tool thereto, is difficult and time-consuming, particularly in the field.

BRIEF SUMMARY OF THE INVENTION

It is an object of the present invention to provide an assembly which allows an operating tool to be quickly released from, or attached to, a machine.

It is a preferred object to provide an assembly which, when the tool is attached, safely locks the tool in position.

It is a further preferred object to provide an assembly which can be operated without the operator having to leave his operating station on the machine.

Other preferred objects of the present invention will become apparent from the following description.

In one aspect, the present invention resides in a quick release and attachment assembly for an earthmoving or excavating machine or the like, comprising:

a first attachment means including a base, at least two opposed stop members fixed on the base, and locating means on the base adjacent at least one of the stop members; and a second attachment means including an attachment head adapted to engage the locating means, a fixed stop engagement means on the attachment head adapted to engage one of the stop members, a movable stop engagement means on the attachment head movable between a first position engaging the second of the stop members and a second position released from the second stop member, and means to move the movable stop engagement means;

one of the attachment means being connectable to the earthmoving or excavating machine and the other attachment means being connectable to an operating tool for the machine.

Preferably the base of the first attachment means is bolted, welded or otherwise fastened to or formed integrally of, the operating tool, e.g. a bucket, blade or ripper pick, while the attachment head of the second attachment means is pivotally mounted on the boom or the lifting arm (or arms) of the earthmoving or excavating machine.

Preferably the locating means includes a pair of laterally spaced, parallel side plates fixed on the base, the attachment head being received and located between the side plates.

The first stop member may include a transverse bar, rod, block or beam fixed between the side plates and may be spaced above the base to enable a portion of fixed stop engagement means to be engaged between the first stop member and the base.

The second stop member may include a hook or jaw welded to the base having a nose or tooth directed towards the first stop member.

The attachment head may include a housing having a pair of spaced side walls interconnected by a base plate. Mounting lugs may be provided on the side walls to receive pivot pins which pivotally connect the housing to the boom or lifting arm(s).

The fixed stop engagement means may include a pair of aligned tapered slots formed at one end of the side walls of the housing, the slots engaging the transverse bar or beam. Preferably, lateral flanges are provided along the sides of the slots to increase the load bearing area between the slots and the bar or beam.

The movable stop engagement means may include a movable jaw slidably mounted on guides or tracks, or pivotally mounted on a pin, on the base plate of the housing, and a hydraulic ram or mechanical screw may be employed to move the movable jaw into, or out of, engagement with the fixed hook or jaw.

BRIEF DESCRIPTION OF THE DRAWINGS

To enable the invention to be fully understood, a preferred embodiment will now be described with reference to the accompanying drawings, in which.

DETAILED DESCRIPTION OF THE PREFERRED EMBODIMENT

Figure 1:
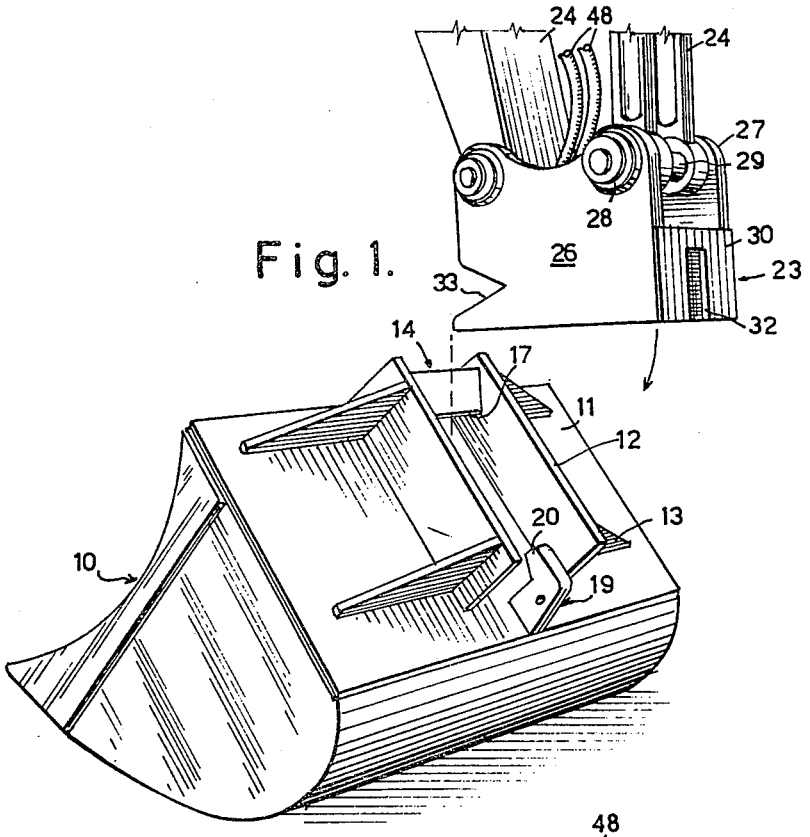
FIG. 1 is a perspective view showing the attachment head adjacent a bucket scoop prior to attachment.
Figure 2:
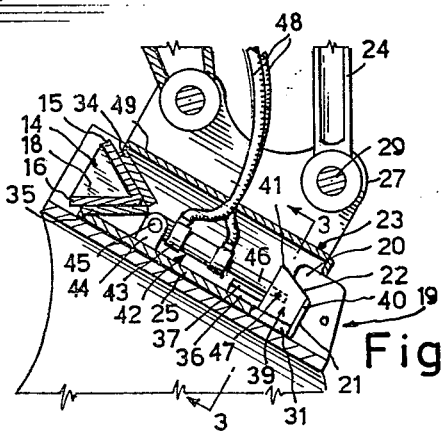
FIG. 2 is a sectional side view showing the attachment head attached to the bucket.
Figure 3:
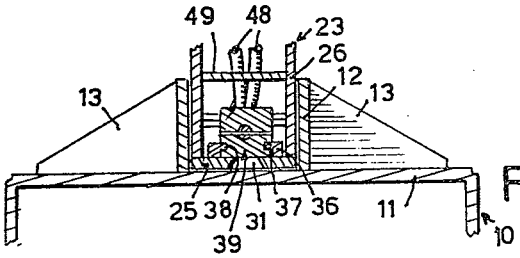
FIG. 3 is a sectional end view taken on line 3—3 on FIG. 2.

The bucket scoop has a substantially planar rear wall 11.

A pair of parallel side plates 12 are welded to the rear wall 11 and are provided with suitable bracing gussets 13.

A V-section beam 14 extends transversely to the rear wall 11, spaced a small distance above the wall, and is welded at its ends to the side plates 12 adjacent the front end of the plates. The walls 15, 16 of the beam 14 are rearwardly convergent to an apex 17. Triangular bracing flanges 18 are provided at spaced intervals along the beam 18. A fixed jaw 19 is welded centrally to the rear wall 11 of the bucket scoop 10 and is terminated by a forwardly directed tooth 20 to define vertical- and inclined abutment faces 21, 22.

The attachment head 23 is mounted on the distal end of the boom 24 (only a portion of which is shown) of an excavating machine.

The head 23 has a base plate 25 dimensioned to fit between the side plates 12 on the bucket scoop 10. A pair of vertical side walls 26 are welded on the base plate 25 and are provided with lugs 27 having bushes 28, in which are journalled suitable pivot pins 29 on the boom 24. A rear wall 30 interconnects the side walls 26 and base plate 25.

Aligned slots 31, 32 (having outwardly divergent walls) are formed centrally in the base plate 25 and rear wall 30 to receive the fixed jaw 19.

Aligned V-shaped slots 33, dimensioned to receive the transverse beam 14, are provided at the front ends of the side walls 26 and lateral flanges 34, 35 extend inwardly along the sides of the slots 33 to provide additional load bearing surfaces between the sides of the slots 33 and the beam 14.

A pair of parallel guides 36 are welded to the rearward portion of the base plate 25 parallel to the longitudinal axis of the head 23. Each guide 36 has an inwardly directed horizontal flange 37 which is slidably received in a respective groove 38 along the side faces of a movable jaw 39. The movable jaw 39 has a vertical front face 40 and rearwardly inclined upper face 41 which corresponds to the abutment faces 21, 22 respectively on the fixed jaw 19.

A hydraulic ram 42 has its cylinder 43 pivotally connected to a pair of vertical support posts 44 (welded to the base plate 25) by a pivot pin 45. The free end of the piston rod 46 has a reduced diameter to form a peripheral abutment face. The reduced diameter portion is received in a bore (not shown) in the movable jaw 39 and is secured therein by a removable locking pin 47. The abutment face bears against the front face of the movable jaw 39 when the piston rod 46 is extended from the cylinder 43.

The ram 42 is connected to the hydraulic system (not shown) of the excavating machine by suitable hydraulic hoses 48 which pass through a removable cover 49 secured to the side walls 26 of the head by fasteners (not shown).

The operation of the attachment will now be described.

Referring to FIG. 1, the head 23 is released from the bucket scoop 10 and the ram 42 is retracted so that the movable jaw 39 is adjacent the rear end of the cylinder 43. The operator moves the boom 24 so that the side walls 12 and side walls 26 are aligned and the forward ends of the side walls 26 are rearward of the apex 17 of the transverse beam 14. He lowers the boom 24 and head 23 until the forward end of the base plate 25 engages the rear wall 11 of the bucket scoop 10 and then moves the head 23 forwardly until the transverse beam 14 is engaged in the aligned slots 33. He then lowers the rearward end of the head 23 so that the fixed jaw 20 is received in the slots 32 (in the base plate 25) and 32 (in the rear wall 30).

The ram 42 is extended to move the movable jaw 39 along the guides 36 until the front and upper faces 40, 41 on the movable jaw 39 engage the abutment faces 21, 22 respectively on the fixed jaw 19.

The bucket scoop 10 is now securely connected to the boom 24 of the excavating machine and may be used in the known manner.

To release the bucket scoop, the operation is reversed and a different tool, e.g. a ripper pick, may be connected to the boom 24.

The attachment or release of the tool from the machine can be carried out very quickly and the operator can control the whole operation without leaving his station on the machine. Experiments have shown that a tool may be attached to, or released from, a machine over 100 times faster than with present attachment and release devices.

While the embodiment has only referred to a bucket scoop 10 on an excavating machine, the applications for the present invention are almost infinite. For example, alternative applications include quick-release hitches for vehicles, e.g. tractors and cane wagons or ploughs, articulated vehicle turntables or railway couplings, and quick release couplings or latches for load carrying frames or bodies.

In a modified form (not shown) of the present invention, the transverse beam 14 may be replaced by fixed jaws similar to the fixed jaw 19 but with rearwardly directed teeth 20. Alternatively, the transverse beam 14 may be replaced by a transverse rod or box-section beam, while the hydraulic ram 42 may be replaced by a mechanical screw means to advance and retract the movable jaw 39.

Various changes and modifications may be made to the embodiment described without departing from the scope of the present invention as defined in the appended claims.

We claim:

1. A quick release and attachment assembly for an earthmoving or excavating machine or the like comprising:

a first attachment means including a base (11), at least two opposed stop members (14, 19) fixed on the base, and locating means (12) on the base (11), said locating means (12) including a pair of laterally spaced, parallel side plates (12) fixed on the base (11), one of said stop members (14) extending transversely between said side plates (12) to provide a large surface area of contact; and a second attachment means including an attachment head (23) having parallel, side plates (26) and an interconnecting base plate (25) and rear wall (30), said side plates (26) fitting closely within the side plates (12) of the first attachment means thereby to prevent lateral movement of said second attachment means when mounted on said first attachment means, a fixed stop engagement means (33) on the attachment head (23) extending laterally between said side plates (26) thereof and adapted to engage said one (14) of the stop members, said fixed stop engagement means (33) presenting a relatively large surface area of contact, with the respective surface areas being such that wear is readily compensated for; a movable stop engagement means (39) on the attachment head (23) movable between a first position engaging the second (19) of the stop members and a second position released from the second stop member (19), said movable stop engagement means (39) and said second stop member (19) having mating wedge surfaces to provide tight locking of one within the other and also to compensate for any wear at such mating surfaces, and means (42) to move the movable stop engagement means (39);

one of the attachment means being connectable to the earthmoving or excavating machine (24) and the other attachment means being connectable to an operating tool (10) for the machine.

2. The assembly as claimed in claim 1 wherein:

the base (11) of the first attachment means is fastened to, or formed integrally with, the operating tool (10); and the attachment head (23) is pivotally mounted on boom means (24) of the earthmoving or excavating machine.

3. The assembly as claimed in claim 1 wherein:

the first stop member (14) includes a transverse beam (14) fixed between the side plates (12) spaced above the base (11); and the second stop member (19) includes hook means (19) fixed to the base (11) having a tooth (20) directed towards the first stop member (14).

4. The assembly as claimed in claim 3 wherein:

the fixed stop engagement means (33) includes a pair of aligned tapered slots (33) formed at one end of the side plates (26) to engage the transverse beam (14), transverse flanges (34,35) extending transversely between the side plates (26) and defining a slot interiorly of the slide plates (26) to increse the load bearing area between the slots (33) and the transverse beam (14).

5. The assembly as claimed in claim 3 wherein:

the movable stop engagement means (39) includes a movable jaw (39) slidably mounted on at least one guide or track (37) on the base plate (25) of the housing (23), said jaw (39) having a wedge surface (41) adapted to engage a mating surface (22) on the tooth (20) of the second stop member (19), and;

the means (42) to move the movable jaw (39) comprises a hydraulic ram (42) mounted on the base plate (25) of the housing (23) and releasably connectable to the movable jaw.

6. The assembly as claimed in claim 5 wherein said movable jaw (39) is further provided with a planar front fall (40) which engages a planar surface (21) on said tooth (20) when said movable jaw (39) is actuated to lock the respective attachment means together.

7. The assembly as claimed in claim 1, wherein:

the attachment head (23) includes mounting lugs (27) provided on the side plates (26) to receive pivot pins (29) connecting the housing (23) to the boom means (24).

* * * * *